US011319203B1

(12) United States Patent
Angus

(10) Patent No.: US 11,319,203 B1
(45) Date of Patent: May 3, 2022

(54) FUNNEL

(71) Applicant: Elliot Angus, Huntington, NY (US)

(72) Inventor: Elliot Angus, Huntington, NY (US)

( * ) Notice: Subject to any disclaimer, the term of this patent is extended or adjusted under 35 U.S.C. 154(b) by 0 days.

(21) Appl. No.: 17/367,466

(22) Filed: Jul. 5, 2021

(51) Int. Cl.
*B67C 11/02* (2006.01)
*B25B 27/00* (2006.01)

(52) U.S. Cl.
CPC ..... *B67C 11/02* (2013.01); *B25B 27/0042* (2013.01); *B67C 2011/025* (2013.01)

(58) Field of Classification Search
CPC ..... B67C 11/02; B67C 2011/027; B67C 2011/022; B67C 2011/025; B25B 27/0042; F16N 31/002
USPC ..... 141/331–345; 184/1.5
See application file for complete search history.

(56) References Cited

U.S. PATENT DOCUMENTS 5,803,140 A * 9/1998 Jodoin ..... B67C 11/02 141/332
5,852,961 A * 12/1998 Kotowski ..... B25B 27/0042 81/180.1
5,979,516 A * 11/1999 Grant ..... F01M 11/0408 141/114
6,546,566 B1 * 4/2003 Geisel ..... A47K 11/12 4/144.1
7,246,639 B2 * 7/2007 Kuntz ..... B64F 1/28 141/311 A
2018/0355595 A1 * 12/2018 Hillsten ..... E03C 1/264

FOREIGN PATENT DOCUMENTS

CN 203551320 U * 4/2014
DE 29515307 U1 * 11/1995 ..... B67C 11/02

OTHER PUBLICATIONS

English translation of abstract of CN203551320U; published Apr. 16, 2014 (Year: 2014).*

* cited by examiner

*Primary Examiner* — Timothy P. Kelly
(74) *Attorney, Agent, or Firm* — Bruce A. Lev

(57) ABSTRACT

An improved funnel includes an inner liner formed from a hydrophobic material, wherein oil from an automobile can contact and pass through said funnel without leaving any oil residue upon said inner liner, such that the funnel can be used for a different type of liquid immediately thereafter without cleaning. The improved funnel may also include a tool cut-out formed through its top rim and a portion of its side wall to allow an oil bolt or oil filter wrench to pass therethrough and be used when the improved funnel is placed adjacent to an automobile oil discharge aperture. The improved funnel may also include magnets to releasably hold the improved funnel to the automobile when in use.

16 Claims, 3 Drawing Sheets

FUNNEL

CROSS-REFERENCE TO RELATED APPLICATION

There are no related applications incorporated herein by reference.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

BACKGROUND OF THE INVENTION

1. Field of the Invention

This invention relates generally to funnels, and specifically to funnels used for funneling oil flowing from an oil discharge aperture of an automobile and into an oil holding container.

2. Description of the Related Art

Prior art funnels used for funneling motor oil need to be cleaned afterwards before being used for funneling a different type of liquid to avoid contamination of the secondary liquid. This creates an extra step when servicing vehicles. The alternative is to use another clean funnel, which is more costly and may not be available. The instant invention overcomes these particular problems by including an inner liner formed from a hydrophobic material, wherein oil from an automobile can contact and pass through said funnel without leaving any oil residue upon said inner liner, and as such, said funnel can be used for a different type of liquid immediately thereafter without cleaning.

BRIEF SUMMARY OF THE INVENTION

In view of the foregoing disadvantages inherent in the known types of toilet cleaners or like in the prior art, the present invention provides an improved funnel that includes an inner liner formed from a hydrophobic material, wherein oil from an automobile can contact and pass through said funnel without leaving any oil residue upon said inner liner, and as such, said funnel can be used for a different type of liquid immediately thereafter without cleaning.

As such, the general purpose of the present invention, which will be described subsequently in greater detail, is to provide an improved funnel with all the advantages of the prior art and none of the disadvantages.

There has thus been outlined, rather broadly, the more important features of the invention in order that the detailed description thereof that follows may be better understood and in order that the present contribution to the art may be better appreciated.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

BRIEF DESCRIPTION OF THE DRAWINGS

The figures which accompany the written portion of this specification illustrate embodiments according to the teachings of the present invention.

The various embodiments of the present invention will hereinafter be described in conjunction with the appended drawings.

DETAILED DESCRIPTION

The embodiments of the present disclosure described below are not intended to be exhaustive or to limit the disclosure to the precise forms disclosed in the following detailed description. Rather, the embodiments are chosen and described so that others skilled in the art may appreciate and understand the principles and practices of the present disclosure.

The following embodiments and the accompanying drawings, which are incorporated into and form part of this disclosure, illustrate embodiments of the invention and together with the description, serve to explain the principles of the invention. To the accomplishment of the foregoing and related ends, certain illustrative aspects of the invention are described herein in connection with the following description and the annexed drawings. These aspects are indicative, however, of but a few of the various ways in which the principles of the invention can be employed and the subject invention is intended to include all such aspects and their equivalents. Other advantages and novel features of the invention will become apparent from the following detailed description of the invention when considered in conjunction with the drawings.

Figure 1:
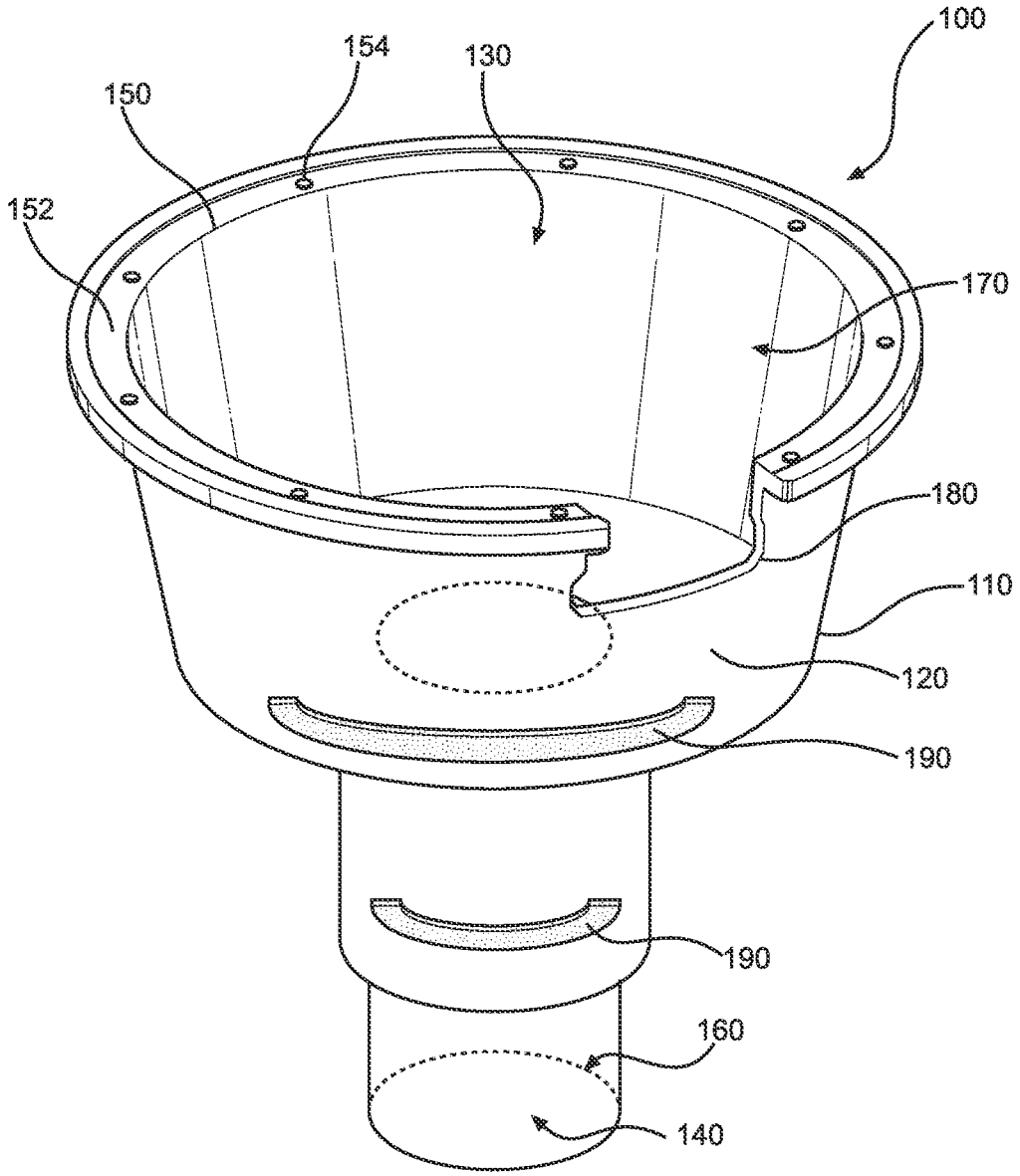
FIG. 1 shows a perspective view of the improved funnel according to the preferred embodiment of the present invention.
Figure 2:
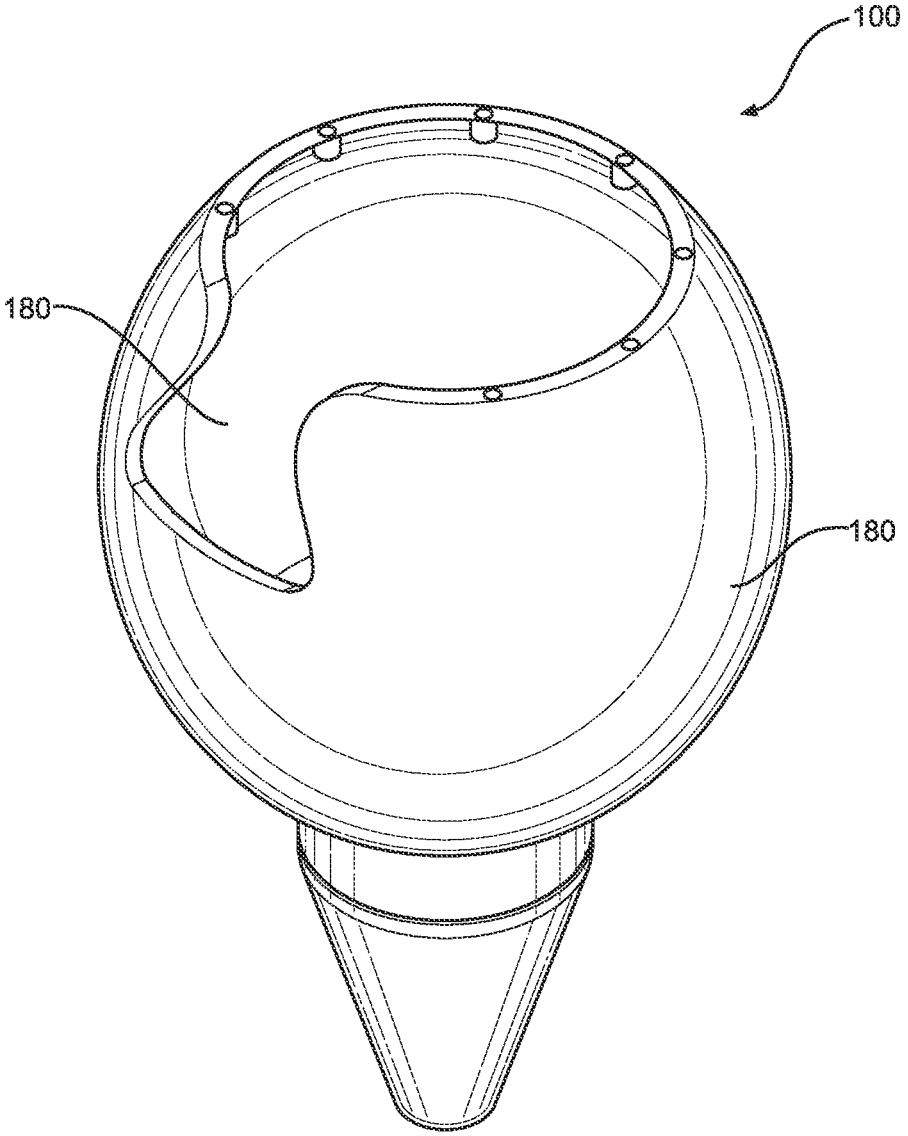
FIG. 2 shows a perspective view of the improved funnel according to the preferred embodiment of the present invention of FIG. 1.
Figure 3:
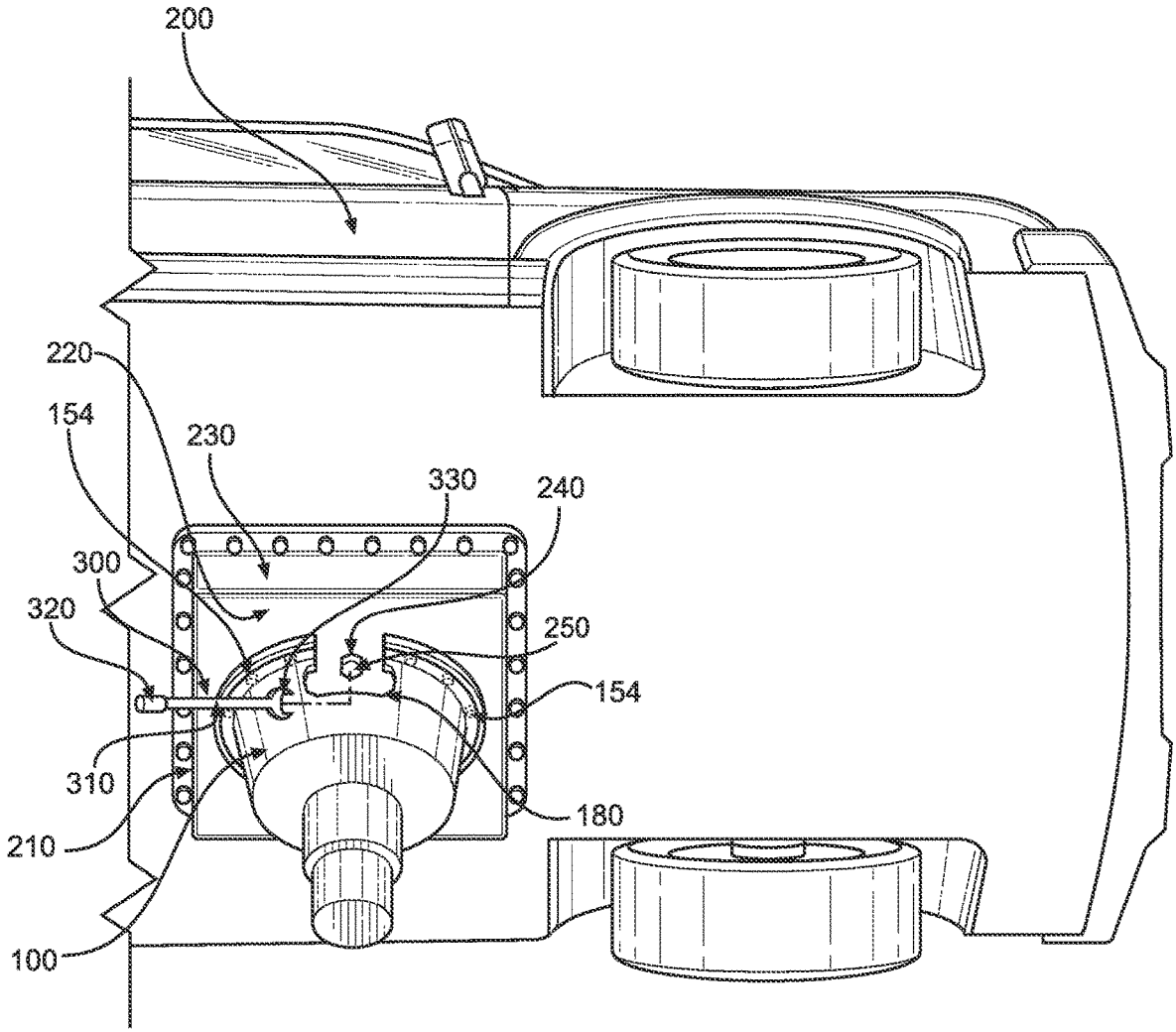
FIG. 3 shows a perspective view of the improved funnel of the instant invention used upon an automobile oil pan according to the preferred embodiment of the present invention of FIG. 1.

Turning now descriptively to drawing, referring to FIGS. 1-3, the improved funnel 100 includes a main body 110 comprising at least one side wall 120 that forms a funnel shape including an open top portion 130 and an open bottom portion 140, wherein the open top portion is larger than the open bottom portion, wherein the at least one side wall forms a top rim 150, wherein the at least one side wall forms a bottom rim 160, wherein the at least one side wall forms an inner surface extending from the top rim to the bottom rim, and wherein the at least one side wall forms an outer surface extending from the top rim to the bottom rim; and an inner liner 170 attached to a substantial portion of the inner surface of the main body, wherein said inner liner is formed from a hydrophobic material, wherein oil from an automotive vehicle can contact and pass through the funnel without leaving any oil residue upon the inner liner, and as such, the funnel can be used for a different type of liquid immediately thereafter without cleaning.

The main body 110 of the improved funnel is formed from a material chosen from a group of materials consisting of metal, plastic, fiberglass, and ceramic.

The improved funnel further comprises a top ledge 152 attached to and extending from the top rim, and at least one magnet 154 attached to the top ledge and adapted to releasably attach and securely hold the funnel to a metallic portion of a vehicle adjacent to an oil discharge location. The main body 110 may further comprise a tool cut-out 180 formed through the top rim, the top ledge, and a portion of the at least one side wall adjacent to the top rim, and is adapted to allow a tool to pass therethrough and be used upon an oil retaining item while the funnel is attached to the metallic portion of said vehicle. The main body 110 further may comprise gripping members 190 formed from EPDM rubber attached to the outer surface thereof and adapted to allow a user to more securely grip said funnel when in use.

The main body 110 of the improved funnel and the inner liner 170 may be formed having a rectangular cross-section. The main body 110 and said inner liner 170 may also be formed having a circular cross-section. Furthermore, the hydrophobic material of the inner liner may be formed from hydrophobic nano-coating.

As shown in FIG. 3, the improved funnel of the instant invention is most commonly used upon an automobile oil pan 210, of an automobile 200, which includes a bottom wall 220 and at least one side wall 230 extends upwardly from said bottom wall, an oil discharge aperture 240 through the bottom wall, and an oil bolt 250 releasably connected to the oil discharge aperture, wherein the automobile oil pan is adapted to releasably retain automobile oil therein, and wherein the funnel is adapted to be placed adjacent to the bottom wall of the automobile oil pan and used to funnel oil flowing from the oil discharge aperture and into an oil holding container.

Also as shown in FIG. 3, an oil bolt wrench 300, or even an oil filter wrench, can be used more easily with the improved funnel. In particular, the oil bolt wrench 300 includes an elongated body 310 including a proximal end and a distal end opposite from the proximal end, a handle 320 attached to the proximal end, and a bolt gripping member 330 attached to the distal end, wherein the oil bolt wrench 300 is adapted to pass through the tool cut-out 180 and releasably grip and turn the oil bolt 250 of the automobile's oil pan 210, and in turn a filter wrench can also releasably grip and turn an oil filter, when the funnel is attached to the bottom wall 220 of the oil pan 210. The oil bolt wrench 300 can be formed as a standard gripping wrench or a ratchet wrench. The oil filter wrench can be formed as a . . . .

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention.

Although the invention has been explained in relation to its preferred embodiment, it is to be understood that many other possible modifications and variations can be made without departing from the spirit and scope of the invention.

What is claimed is:

1. A funnel for use with automotive oils comprising:
- a main body comprising:
  - at least one side wall:
    - wherein said at least one side wall forms a funnel shape including an open top portion and an open bottom portion;
    - wherein said open top portion is larger than said open bottom portion;
    - wherein said at least one side wall forms a top rim;
    - wherein said at least one side wall forms a bottom rim;
    - wherein said at least one side wall forms an inner surface extending from said top rim to said bottom rim; and
    - wherein said at least one side wall forms an outer surface extending from said top rim to said bottom rim; and
  - a tool cut-out;
    - wherein said tool cut-out is formed through said top rim, and a portion of said at least one side wall adjacent to said top rim, and adapted to allow a tool to pass therethrough and be used upon an oil retaining item while said funnel is attached to a metallic portion of said vehicle; and
- an inner liner;
  - wherein said inner liner is attached to a substantial portion of said inner surface of said main body; and
  - wherein said inner liner is formed from a hydrophobic material;
- wherein when oil from an automotive vehicle contacts and passes through said funnel it will not leave any oil residue upon said inner liner, and as such, said funnel is adapted to be available for use with a different type of liquid immediately thereafter without cleaning.

2. The funnel of claim 1, wherein said main body is formed from a material chosen from a group of materials consisting of metal, plastic, fiberglass, and ceramic.

3. The funnel of claim 1, further comprising a top ledge attached to and extending from said top rim; and at least one magnet attached to said top ledge and adapted to releasably attach and securely hold said funnel to said metallic portion of a vehicle adjacent to an oil discharge location.

4. The funnel of claim 3, wherein said main body further comprises a gripping member attached to said outer surface thereof adapted to allow a user to securely grip said funnel when in use.

5. The funnel of claim 4, wherein said gripping member is formed from EPDM rubber.

6. The funnel of claim 1, wherein said main body and said inner liner are formed having a rectangular cross-section.

7. The funnel of claim 1, wherein said main body and said inner liner are formed having a circular cross-section.

8. The funnel of claim 1, wherein said hydrophobic material is formed from hydrophobic nano-coating.

9. A combination of a funnel and an automobile oil pan, comprising:
- an automobile oil pan including:
  - a bottom wall including:
    - an oil discharge aperture therethrough; and
    - an oil bolt releasably connected to said oil discharge aperture;
  - at least one side wall:
    - wherein said at least one side wall is attached to and extends upwardly from said bottom wall;
  - wherein said automobile oil pan is adapted to releasably retain automobile oil therein; and
- a funnel comprising:
  - a main body comprising:
    - at least one side wall:
      - wherein said at least one side wall forms a funnel shape including an open top portion and an open bottom portion;

wherein said open top portion is larger than said open bottom portion;

wherein said at least one side wall forms a top rim;

wherein said at least one side wall forms a bottom rim;

wherein said at least one side wall forms an inner surface extending from said top rim to said bottom rim; and wherein said at least one side wall forms an outer surface extending from said top rim to said bottom rim; and a tool cut-out;

wherein said tool cut-out is formed through said top rim, and a portion of said at least one side wall adjacent to said top rim, and adapted to allow a tool to pass therethrough and be used upon an oil retaining item while said funnel is attached to a metallic portion of said vehicle; and an inner liner;

wherein said inner liner is attached to a substantial portion of said inner surface of said main body; and wherein said inner liner is formed from a hydrophobic material;

wherein when oil from an automotive vehicle contacts and passes through said funnel it will not leave any oil residue upon said inner liner, and as such, said funnel is adapted to be available for use with a different type of liquid immediately thereafter without cleaning;

wherein said funnel is adapted to be placed adjacent to said bottom wall of said automobile oil pan and used to funnel oil flowing from said oil discharge aperture and into an oil holding container.

10. The combination of claim 9, wherein said main body is formed from a material chosen from a group of materials consisting of metal, plastic, fiberglass, and ceramic.

11. The combination of claim 9, further comprising a top ledge attached to and extending from said top rim; and at least one magnet attached to said top ledge and adapted to releasably attach and securely hold said funnel to said bottom wall of said automobile oil pan adjacent to and surrounding said oil discharge aperture.

12. The combination of claim 9, wherein said hydrophobic material is formed from hydrophobic nano-coating.

13. A combination of a funnel and an oil bolt wrench, comprising:

an oil bolt wrench including:

an elongated body including:

a proximal end: and a distal end opposite from said proximal end;

a handle:

wherein said handle is attached to said proximal end;

a bolt gripping member:

wherein said bolt gripping member is attached to said distal end;

wherein said oil bolt wrench is adapted to releasably grip and turn an oil bolt of an automobile's oil pan; and a funnel comprising:

a main body comprising:

at least one side wall:

wherein said at least one side wall forms a funnel shape including an open top portion and an open bottom portion;

wherein said open top portion is larger than said open bottom portion;

wherein said at least one side wall forms a top rim;

wherein said at least one side wall forms a bottom rim;

wherein said at least one side wall forms an inner surface extending from said top rim to said bottom rim; and wherein said at least one side wall forms an outer surface extending from said top rim to said bottom rim; and a tool cut-out;

wherein said tool cut-out is formed through said top rim and a portion of said at least one side wall adjacent to said top rim, and adapted to allow said oil bolt wrench to pass therethrough and be used upon said oil bolt when said funnel is placed adjacent to said automobile oil pan; and an inner liner;

wherein said inner liner is attached to a substantial portion of said inner surface of said main body; and wherein said inner liner is formed from a hydrophobic material;

wherein when oil from an automotive vehicle contacts and passes through said funnel it will not leave any oil residue upon said inner liner, and as such, said funnel is adapted to be available for use with a different type of liquid immediately thereafter without cleaning; and wherein said funnel is adapted to be placed adjacent to a bottom wall of said automobile oil pan and used to funnel oil flowing from an oil discharge aperture of said automobile oil pan and into an oil holding container.

14. The combination of claim 13, wherein said main body is formed from a material chosen from a group of materials consisting of metal, plastic, fiberglass, and ceramic.

15. The combination of claim 13, further comprising a top ledge attached to and extending from said top rim; and at least one magnet attached to said top ledge and adapted to releasably attach and securely hold said funnel to said bottom wall of said automobile oil pan adjacent to and surrounding said oil discharge aperture.

16. The combination of claim 13, wherein said hydrophobic material is formed from hydrophobic nano-coating.

* * * * *